US005536223A

United States Patent [19]

Ferber

[11] Patent Number: 5,536,223

[45] Date of Patent: Jul. 16, 1996

[54] EXERCISE DEVICE

[76] Inventor: Dennis A. Ferber, 3351 Caminomira Costa Ste C–1, San Clemente, Calif. 92672

[21] Appl. No.: 501,949

[22] Filed: Jul. 13, 1995

Related U.S. Application Data

[63] Continuation-in-part of Ser. No. 267,063, Jun. 27, 1994, Pat. No. 5,445,581.

[51] Int. Cl.[6] ..... A63B 23/14; A63B 21/015

[52] U.S. Cl. ..... 482/46; 482/118; 482/44; 482/115

[58] Field of Search ..... 482/44, 45, 46, 482/114, 115, 118

[56] References Cited

U.S. PATENT DOCUMENTS

| | | | |
|---|---|---|---|
| 2,668,055 | 2/1954 | Sharp et al. | 482/46 |
| 3,184,234 | 5/1965 | Struble | 482/118 |
| 3,211,453 | 10/1965 | Williams | 482/46 |
| 3,315,959 | 4/1967 | Carnielli | 482/118 |
| 3,516,661 | 6/1970 | Hanson | 482/115 |
| 4,203,591 | 5/1980 | Gibson | 482/46 |
| 4,374,588 | 2/1983 | Ruggles | 482/118 |
| 4,379,552 | 4/1983 | Webb et al. | 482/118 |
| 4,869,492 | 9/1989 | Joutras | 482/118 |
| 5,046,727 | 9/1991 | Wilkinson et al. | 482/118 |
| 5,167,596 | 12/1992 | Ferber | 482/114 |

*Primary Examiner*—Lynne A. Reichard
*Attorney, Agent, or Firm*—William Patrick Waters

[57] ABSTRACT

An exercise device having a coupling assembly attaching a pair of elongated handles, is provided for reversible rotation thereabout. Each of the handles includes a tubular housing within which a torque adjustment apparatus is disposed. The coupling assembly permits reversible frictional adjustment of the angle formed by the elongated handles to provide exercise of the musculature of the chest and shoulders as the user moves the arms toward or away from each other. The user can adjust the level of resistance to arm movement by adjustment at the coupling assembly. The coupling assembly includes a first spatulate member having a first elongated arm fixed thereto for rotational movement thereabout, a conical member is fixed at a base to the first spatulate member at an angle to the first elongated arm. An integral anti-rotation boss having an integral threaded rod is fixed to the conical member opposite its base. A second spatulate member, having a second elongated arm fixed thereto, includes an elongated receiving member disposed at an angle to the second elongated arm. The receiving member has a recess for receipt of the conical member, for rotational movement thereabout, and for receipt of an anti-rotation disc which is fixed to the boss. An elongated nut is disposed coaxially within the receiving member for thread engagement with the threaded rod. Cup shaped washers, urged against the anti-rotation disc by the elongated nut provide a capability of altering resistance to movement of the elongated arms.

1 Claim, 6 Drawing Sheets

11
13
21
16
31
32
33
15
17
18
19
22
36
37
35
24
46
55
53
52
25
51
27
47
28
45
43
14
48
41
23
44
29
42
26

EXERCISE DEVICE

CROSS REFERENCE TO RELATED APPLICATION

This is a continuation in part patent application of a patent application entitled "Exercise Device", filed Jun. 27, 1994, Ser. No. 08/267,063, now U.S. Pat. No. 5,445,581. Said patent is incorporated herein by reference.

FIELD OF THE INVENTION

This invention relates generally to exercise devices and, more particularly, to hand held devices for exercise of the musculature of the wrists, forearms, arms, chest and shoulders.

BACKGROUND ART

The value of exercise in promoting and improving health is universally recognized. Health clubs and other organizations having equipment devoted to varying levels of exercise, from the benign to the arduous, have become popular. In general, such clubs serve a useful purpose by providing the opportunity for their members to exercise on a regular basis. A drawback, however, is the fact that in many cases, after paying a the, members lose interest, move away or for other reasons quit visiting the club. Thus, it is recognized that it would be desirable to have exercise equipment which would be readily available to the user.

In addition to the unavailability of some exercise devices, another limitation is that they are often large, cumbersome and expensive. Because of recognition of a need for simpler, easily accessible exercise equipment, and in reaction to the limitations in some conventional devices, smaller, portable and significantly less expensive exercise devices have been developed. Some of these devices have great popular appeal. In order for such devices to function in an acceptable manner, it is highly desirable that, in addition to being portable and inexpensive, they are sturdy and not readily damaged.

Properly designed exercise devices, whether of the large fixed variety, or the smaller portable type, have certain common characteristics. Generally, they exercise single muscles, and muscle groups, by providing a resistance to movement which must be overcome by the user during exercise. Since a muscle or muscle group can exert power only upon contraction, muscle tissue is beneficially exercised when it contracts to overcome the resistance. During exercise, muscular contraction is followed by a brief period of relaxation, which in turn, is followed by contraction as the musculature moves once more against the resistance.

Because muscular strength varies from one person to the next and, indeed, may vary from time to time in the same individual, it is worthwhile to provide an exercise device having some adjustability in resistance. In this manner, users of varying age, strength and health can be benefited from use of a single exercise device. In addition, it is desirable to provide adjustability of resistance for the individual who, over a period of use of the device, finds added strength requires increased resistance to provide a suitable challenge. Such adjustability is often readily achieved in large, fixed exercise devices where electrical controls, for example, can adjust a brake to load a flywheel. However, desired adjustability is substantially more difficult to achieve in a portable, hand held device. Thus, in view of the above mentioned benefits of portable exercise devices, it would be highly desirable to have such a device which would include a reliable adjustability capability.

Hand held exercise devices are popular. One such device enables the user to adjust torque in each of a pair of handles to provide a suitable rotational resistance over a broad range. Since resistance can be adjusted in each handle individually, a wide population of users, having disparate physical strengths, can benefit from use of the device. U.S. Pat. No. 5,445,581 discloses a novel exercise device which, used on a regular basis, provides the user with a suitable conditioning technique. The devices provides a capability of adjusting resistance over a broad spectrum while avoiding the problem of prior art devices in which, as the user backs off a nut to lower resistance, a point is reached, when, without warning to the user, the device comes apart and its internal components spill out. In fact, it was because of this limitation that it appeared advantageous to have an exercise device which was adjustable over a broad range of resistance levels without risk of damage thereto.

The limitations of the prior art exercise devices were overcome by the novel exercise device disclosed and claimed in the aforementioned patent in which a novel technique for varying torque resistance in the handle assemblies is disclosed. This exercise device affords a highly useful exercise device for efficient exercise of the musculature of the wrists, forearm and arms. However, after some experience in use of this device, it was noted that it had limitations if the user desired exercise for the chest and shoulder muscles, in addition to those of the wrist, arm and forearm. Thus, it became evident that it would be highly desirable to have a hand held exercise device having some of the advantageous features of the device of U.S. Pat. No. 5,445,581 but having, in addition, the capability of providing a novel means for exercise of the musculature of the chest and shoulders. Ideally, such a device would be efficient, inexpensive and capable of providing varying resistance to enable an exercise capability over a broad range of user strengths and physical conditions.

DISCLOSURE OF INVENTION

It is an object of the present invention to provide a portable exercise device.

It is another object of the present invention to provide an exercise device capable of conditioning the muscles of the wrist, forearm, arm, chest and shoulder.

It is a further object of the present invention to provide an exercise device which is compact, inexpensive and convenient to use.

It is a still further object of the present invention to provide an exercise device having cooperating structural elements assembled in such a manner as to resist disassembly during use.

It is still another object of the present invention to provide an exercise device having resistance adjustment characteristics to permit muscle conditioning in a broad population of users having differing levels of strength and physical condition.

Briefly, the above and further object of the present invention are realized by providing an exercise device having a coupling assembly attaching a pair of elongated arms. A pair of elongated handles, one mounted on each one of the elongated arms, is provided for reversible rotation thereabout. Each of the handles includes a tubular housing within which a torque adjustment apparatus is disposed. The coupling assembly permits reversible frictional adjustment of the angle formed by the elongated arms to provide exercise of the musculature of the chest and shoulders as the user moves the arms toward or away from each other in a "hedgeclipper" motion. The user can adjust the level of resistance to arm movement by suitable adjustment at the coupling assembly.

The coupling assembly includes a first spatulate member having a first elongated arm fixed thereto for rotational movement thereabout, a conical member is fixed at a base to the first spatulate member at an angle to the first elongated arm. An integral anti-rotation boss having an integral threaded rod is fixed to the conical member opposite its base. A second spatulate member, having a second elongated arm fixed thereto, includes an elongated receiving member disposed at an angle to the second elongated arm. The receiving member has a recess for receipt of the conical member, for rotational movement thereabout, and for receipt of an anti-rotation disc which is fixed to the boss. An elongated nut is disposed coaxially within the receiving member for threaded engagement with the threaded rod. Cup shaped washers, urged against the anti-rotation disc by the elongated nut, provide a capability of altering resistance to movement of the elongated arms.

The present invention affords several advantages. A significant advantage is that the novel coupling assembly permits exercise of the wrists, forearms and arms by rotation of the handles while simultaneously providing a "hedgeclipper" type of motion for exercise of the chest and shoulder muscles as the arms are moved, against a selected resistance, toward and away from each other. In fact, the present invention provides a capability for exercise, utilizing a wide spectrum of adjustable resistance, in three different modes. In the first, the coupling assembly can be locked to hold the arms at a desired angle while the handles alone are rotated. In another mode, the handles can be adjusted to prevent rotation while the hedgeclipper type of motion about the coupling assembly is utilized. Finally, the user may adjust torque resistance in the handles and resistance in the coupling assembly to permit simultaneous rotational movement of the handles while the elongated arms are moved in a reciprocating manner about the coupling assembly axis. Thus, a wide variety of exercises can be accomplished by a single, relatively inexpensive exercise device.

BRIEF DESCRIPTION OF THE DRAWINGS

The above mentioned and other objects and features of this invention and the manner of attaining them will become apparent and the invention itself will be best understood by reference to the following description of the embodiments of the invention in conjunction with the accompanying drawings, wherein.

BEST MODE FOR CARRYING OUT THE INVENTION

Figures 1, 4:
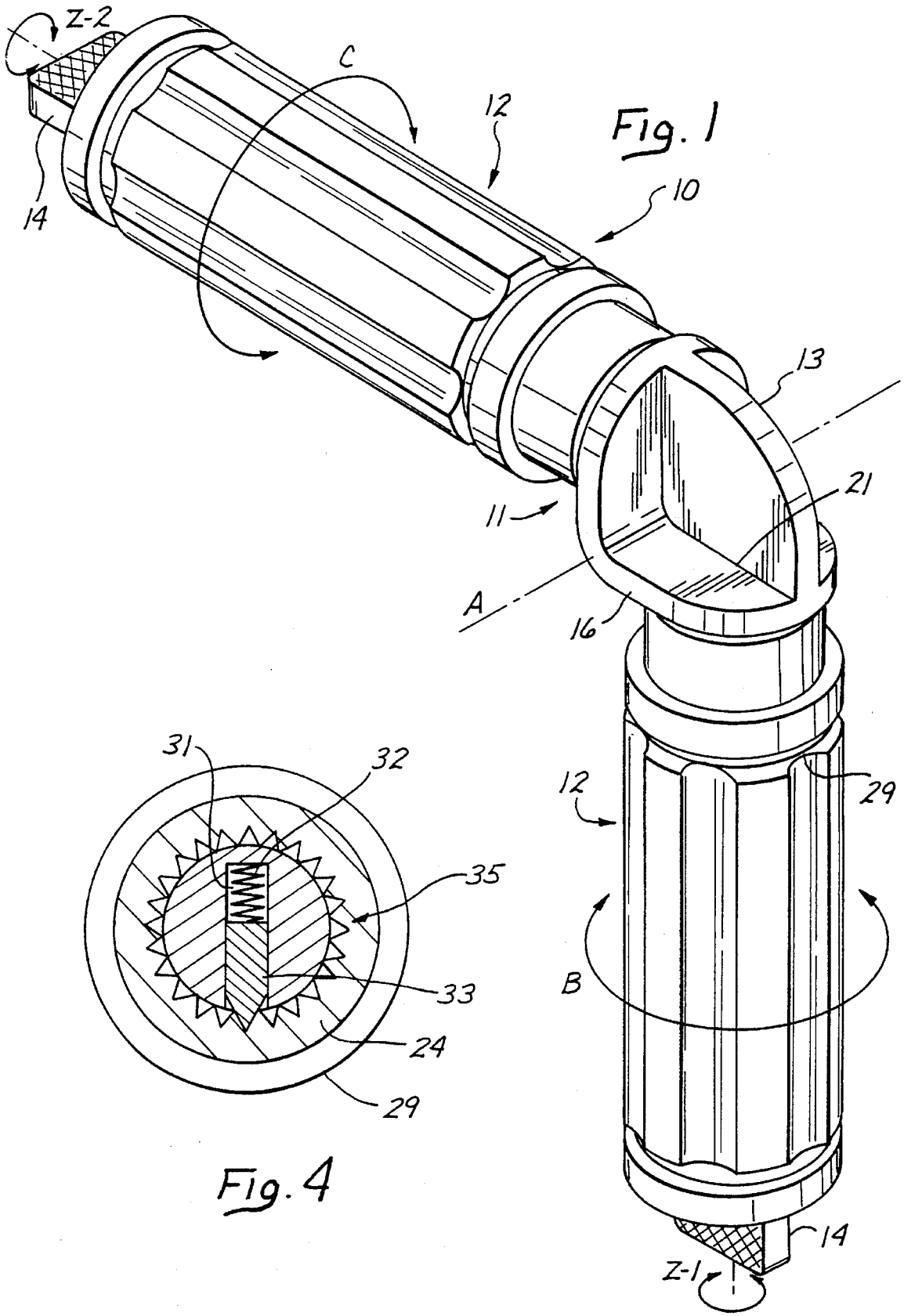
FIG. 1 is an orthographic view of an exercise device of the present invention.
FIG. 4 is a section taken along the line 4—4 of FIG. 2.

Referring now to the drawings, and particularly to FIG. 1 thereof, there is shown a novel portable, hand operated exercise device 10 which is constructed according to the present invention. The device 10 is comprised generally of a pair of elongated handle assemblies 12, disposed generally at a right angle one to the other and connected by a coupling assembly 11 at a shoulder 13.

Figures 2, 5:
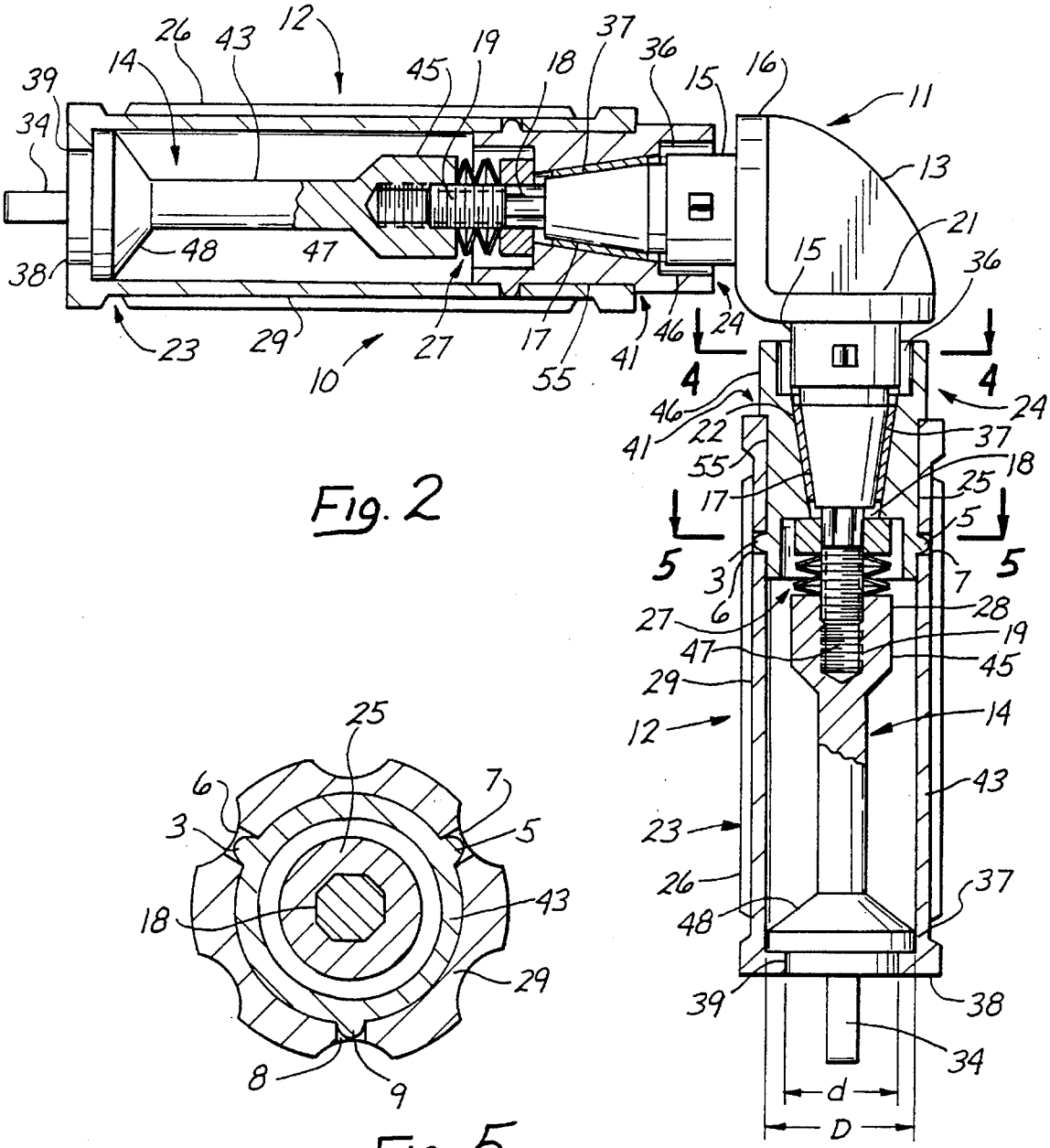
FIG. 2 is a side view in section of the exercise device depicting the internal components thereof.
FIG. 5 is a section taken along the line 5—5 of FIG. 2.

An examination of FIGS. 1 and 2 will reveal that the exercise device 10 is comprised of two portions which are perfectly symmetrical on either side of an imaginary line A, drawn through the shoulder 13. Thus, while the components of one half of the device 10 are described herein in detail, it is to be understood that the discussion applies with equal effect to identical components in the other symmetrical half.

In operation, the user grasps one handle assembly 12 with one hand while the other handle assembly 12 is grasped by the other hand. As discussed in more detail below, exercise is performed when the user rotates the handle assemblies as depicted, respectively, by the arrows B and C, about their respective longitudinal axes Z-1 and Z-2. A finger operated blade 34 can be tightened or loosened to increase or decrease torque resistance of the handle assembly 12. In this manner, the user can increase or decrease resistance to rotation in the individual handle assemblies.

It will be readily appreciated by those skilled in the art that the capability of resistance adjustment in the handle assemblies enables beneficial use of the device 10 by users of varying strengths. In addition, since the resistance levels of the two handle assemblies are separately and individually adjustable, the user can vary the resistance if strength on one side of the body differs from that on the other. Further, it will be appreciated that utilization of the device 10 can significantly benefit the muscles and muscle groups of the hands, wrists, forearms and arms.

Figure 3:
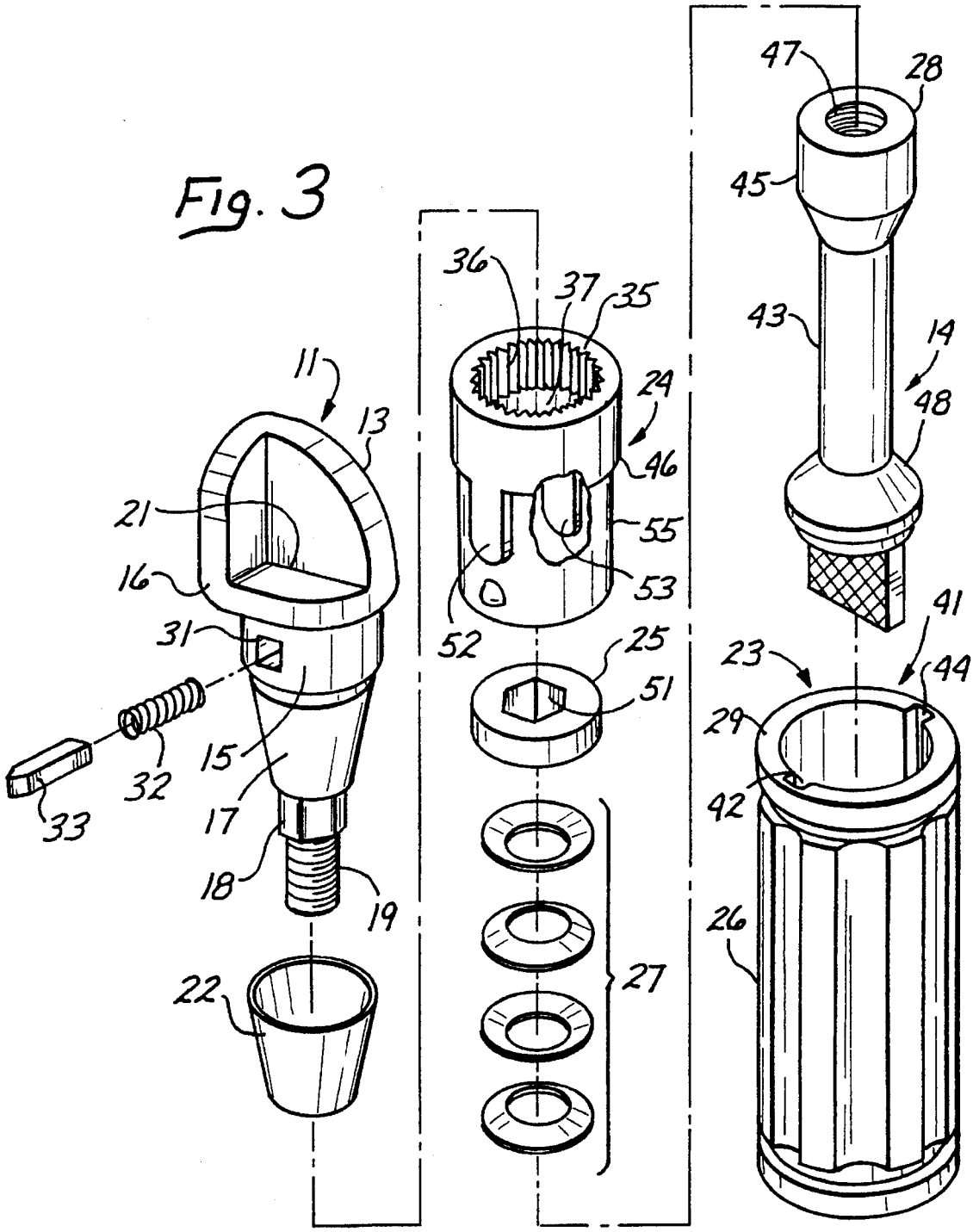
FIG. 3 is an exploded view of a handle assembly of the exercise device.

The operation of the exercise device 10 will be more clearly understood by reference now to FIGS. 2–5. As shown in FIGS. 2 and 3, the handle assemblies 12 are connected together by the coupling assembly 11 at the shoulder 13. The coupling assembly 11 may be formed from a single block of suitable material such as, for example Durethan BKV 130. The shoulder 13 is integrally joined along an inside edge 21 to a flange 16 thereby providing strength to the device 10 and preventing separation of one handle from the other during use. Moving distally from the flange 16, the coupling assembly 11 includes a body portion 15, a conical member 17 tapering distally, and a boss 18. The boss 18 is octagonally shaped in cross section. Extending distally from the boss 18 is a threaded rod 19.

The body portion 15 of the coupling assembly 11 has a generally square shaped radially opened recess 31 for receipt of a compression spring 32 and a pawl 33. The pawl 33 is generally square in cross section and it fits snugly into the recess 31. As more fully seen in FIG. 4, the pawl engages serrations, such as the serrations 35 arranged circumferencially along the inner wall 36 of a collar 46 located at the proximal end of a cone socket 24, to produce a clicking sound during operation of the exercise device 10. Distally from the collar 46, the cone socket 24 includes a body portion 55 having formed on its inside a recess 37 for receipt therein of the conical member 17. A pair of oppositely located keys 52 and 53 project distally from the collar 46 along the outer wall of the body portion 45.

Considering now the handle assembly 12 in greater detail, the assembly includes a tubular housing 23 having a side wall 29 and a distal end wall 38. The end wall 38 has an opening 39 formed therein. The tubular housing 23 is covered over a substantial portion thereof by a ribbed rubber grip 26. Three nub receptacles 6, 7 and 8, equidistant from the end wall 38, are formed in the side wall 29. The openings are spaced at intervals of 120 degrees. At the proximal end 41 of the tubular housing 23 a pair of opposed grooves 42 and 44 are formed on the inside of the side wall 29.

In use of the exercise device 10, rotational resistance can be adjusted by turning an elongated nut 14 which is coaxially disposed within the tubular housing 23. The nut 14 includes a shaft 43 which connects, at its proximal end, to a body portion 45 and, at its distal end, to a distally radially tapered flange 48. The body portion 45 includes a threaded recess 47 for receipt of the threaded rod 19.

A washer assembly 27 is interposed between the nut 14 and the body portion 55 of the socket 24. The washers of the assembly 27 are cup shaped and they provide adjustable frictional resistance to rotation of the handle assembly 12. During use of the device 10, the washer assembly 27 is urged adjustably against an anti-rotation disc 25. The disc 25 has an octagonally shaped opening formed therein so that the disc 25 can be fixed on the boss 18. The diameter of the disc 25 is slightly smaller than the diameter of the cone socket body portion 55 within which it is located upon assembly of the device 10. During rotation of the handle assembly 12, a floating cone bushing 22, interposed between the conical member 17 and the cone socket recess 37 provides smooth rotational movement.

Considering now the features of the present invention for prevention of accidental disassembly, it will be noted that the devices disclosed in U.S. Pat. No. 5,167,596, are susceptible to such disassembly if the adjustment nut is backed off too far. In such cases, without warning, the device comes apart and its components spill out.

In the present invention, the likelihood of such accidental disassembly is eliminated by virtue of cooperation between the flared flange 48 on the elongated nut 14, the nubs 3, 5 and 9 and the nub receptacles 6, 7 and 8. Referring to FIG. 2, it will be seen that the flange 48 has a diameter D which is larger than the diameter d of the opening 39 in the distal wall 38 of the tubular housing 23. Thus, even if the nut 14 were to be backed off as far as possible, the flange 48 would prevent the nut 14 from passing out of the handle assembly 12 through the opening 39. It will be recognized, however, that the flange/opening (D/d) relationship alone is not enough to prevent inadvertent disassembly since nut 14 could be unscrewed from the threaded rod 19 until the two parted and there would be nothing then holding the handle assembly 12 together. In the present invention, however, the threaded rod 19 and the nut 14 are prevented from parting by the cooperation of the nubs 3, 5 and 9 with the tubular housing side wall nub receptacles 6, 7 and 8, respectively. After assembly of the exercise device 10, the seated nubs prevent separation of the threaded rod 19 and the nut 14 by limiting the distance of travel therebetween.

Thus, as a result of the cooperation among elements of the tubular housing, the socket assembly and the elongated nut, problems and limitations of conventional exercise devices are eliminated by the present invention in a novel and nonobvious manner.

Figure 6:
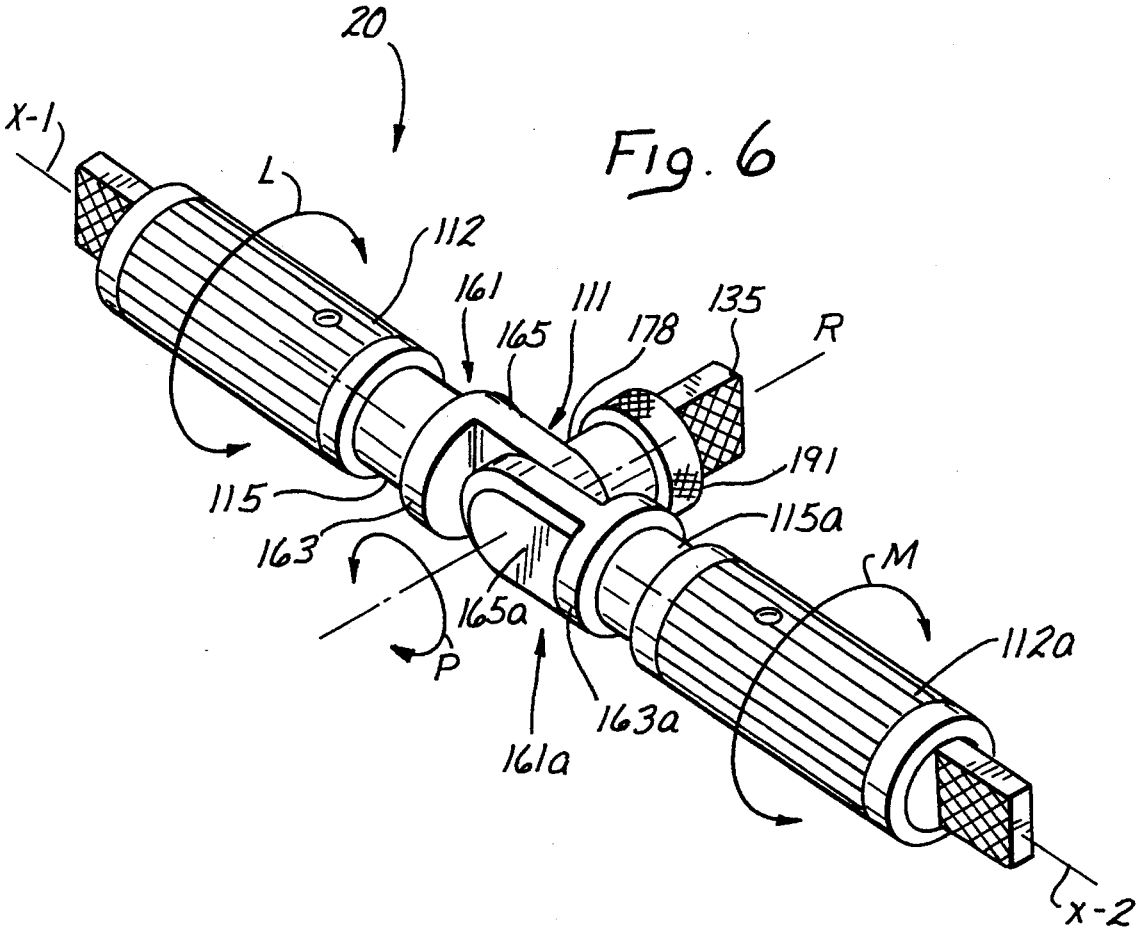
FIG. 6 is an orthographic view of another embodiment of the present invention.
Figure 7:
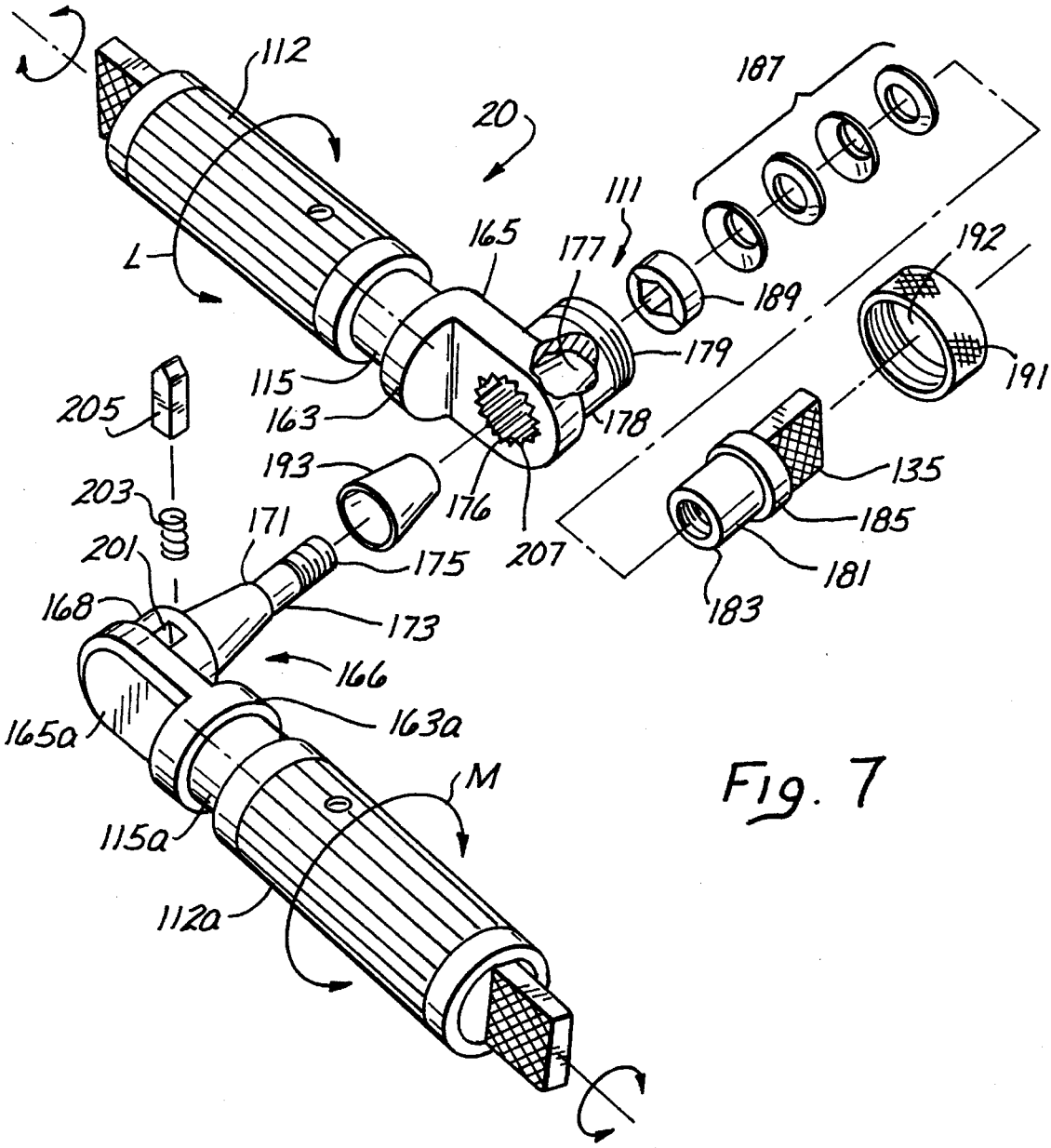
FIG. 7 is a partially exploded view of the invention of FIG. 6.

Referring now to FIGS. 6 and 7, there is shown another portable, hand operated exercise device 20 which is constructed according to the present invention. The device 20 is comprised generally of a pair of elongated handle assemblies 112 and **112*a* each one of which is identical in structure and function, having identical internal components, to the handle assembly 12 of the device 10. The handle assemblies 112 and 112*a* are each connected respectively, for rotational movement thereabout, to body portions 115 and 115*a* each of which is, also, identical in structure and function to the body portion 15 of the device 10. Connected to each one of the body portions 115 and 115*a* are a conical member (not shown) and a boss (not shown) having a threaded rod (not shown) extending therefrom, all in structure and function identical to their respective counterparts in the device 10**.

A coupling assembly 111, disposed between the body portions 115 and **115*a*, enables the user to select and fix the angle formed by the handle assemblies 112 or to alter dynamically the angle against an adjustable resistance. This permits the user to manipulate the device 20** in a "hedge-clipper" type of motion, thereby exercising the chest and shoulder muscles.

Because of the adjustability of resistance m the handle assemblies 112 and **112*a*, as described above with reference to the handle assemblies 12, and adjustability of resistance to movement of the handle assemblies toward and apart from each other, the device 20 provides a wide range of exercise options. Thus, the user is enabled to exercise different muscles groups, in differing ways, with the single exercise device 20. For example, the user may elect to fix the angle between the handle assemblies and manipulate the handle assemblies 112 and 112*a* only. In a second mode, the handle assemblies 112 and 112*a*** can be fixed to prevent rotation and the hedgeclipper type of movement can be employed. In a third mode, the user can utilize the hedge-clipper movements, against a selected resistance, while simultaneously rotationally manipulating the handle assemblies against independently adjustable resistances in the handle assemblies.

In operating the exercise device 20, the user selects a desired rotational resistance for each one of the handle assemblies 112 and **112*a* and grasps the handle assembly 112 with one hand while the handle assembly 112*a* is grasped by the other hand. Exercise is performed when the user rotates the handle assemblies, as depicted by the arrows L and M respectively, about respective axes X-1 and X-2. For the hedgeclipper mode of exercise, the handle assemblies 112 and 112*a* can be moved toward or away from each other, as depicted by arrow P, about an axis R. A finger adjustable blade 135** can be tightened or loosened to increase or decrease resistance of handle assembly movement about the axis R.

Operation of the exercise device, with respect to adjustment of resistance to handle assembly movement, will be more clearly understood by further consideration of the coupling assembly 111. Fixedly attached to the handle assemblies 112 and **112*a* respectively, at the medial end of each, are spatulate members 161 and 161*a* each having a ring portion 163 and 163*a* respectively. Extending medially from the ring portions 163 and 163*a*, and integrally fixed thereto, are blades 165 and 165*a* respectively. The plane of the blade 165 is parallel to the axis X-1 and the plane of the blade 165*a* is parallel to the axis X-2**.

Integrally fixed to the blade **165*a* and extending at a right angle to the axis X-2 is an assembly 166. The assembly 166 comprises a cylindrical base 168 fixed to the blade 165*a* at one end and having a truncated cone 171 at its other end. Extending from the cone 171 is an octagonally shaped boss 173. A threaded rod 175 extends from, and is integrally connected to, the boss 173**.

The blade 165 has a serrated opening 176 formed therein. A cylindrical member 178 is integrally fixed to the blade 165 at a right angle to the axis X-1. The cylindrical member 178 contains a cone shaped receptacle 177 in alignment with the opening 176 and at its end opposite the blade 165, the member 178 includes a threaded portion 179.

The coupling assembly 111 is assembled by inserting the conical assembly 166 through the opening 176 and into the cylinder 178 in such a manner that the cone 171 fits within the cone shaped receptacle 177. A floating conically shaped bushing 193 is disposed within the receptacle 177 between the cone 171 and the cylinder 178 to provide smooth rotational movement about the axis R. Resistance to this movement is controlled by adjustment of the blade 135. The blade 135 is integrally fixed to an end of an elongated nut 181 which includes a threaded body portion 183, located opposite the blade 135. Interposed between the blade 135 and the threaded body portion is a collar 185. As the device 20 is assembled, the threaded body portion 183 of the nut 181 receives the threaded rod 175 to hold the conical assembly 166 securely within the cylinder 178. In the fully assembled device 20, the threaded body portion 183 and the collar 185 fit snugly within the cylinder 178. A washer assembly 187 is interposed between the collar 185 and the conical assembly 166. The washers of the assembly 187 are cup shaped and they enable adjustable frictional resistance to movement of the handles 112 and **112*a* about the axis R. During friction adjustment, the washer assembly 187 is urged reversibly against an anti-rotation disc 189. The disc 189 has a octagonally shaped opening formed in it so that the disc 189 can be fixed on the boss 173**.

As part of assembly, after installation of the components discussed above, a threaded locking ring 191 is screwed onto the threaded portion 179 of the cylinder 178. The ring includes an opening 192 having a diameter smaller than the outside diameter of the collar 185. In this manner, adjustment resistance, by rotating the blade 135 in a clockwise direction to increase resistance, and counterclockwise to decrease resistance, can be readily achieved without concern that the components within the coupling assembly 111 will spill out.

It will be readily understood by one skilled in the art of hand held exercise devices that while in the description of the device 20, the assembly 166 is disposed at a right angle to the blade **165*a* and the cylindrical member 178 is disposed at a right angle to the blade 165**, the present invention is not limited to such right angles. It is within the scope and intention of this specification to include other suitable angular relationships between the elements mentioned herein.

The base 168 of the conical assembly 166 has a generally shaped radially opened recess 201 for receipt of a compression spring 203 and a pawl 205. The pawl 205 is generally square in cross section and it fits snugly in the recess 201. As seen in FIG. 7, the pawl engages serrations, such as a serration 207, arrayed along the opening 176 to produce a clicking sound during operation of the exercise device 20.

Figure 8:
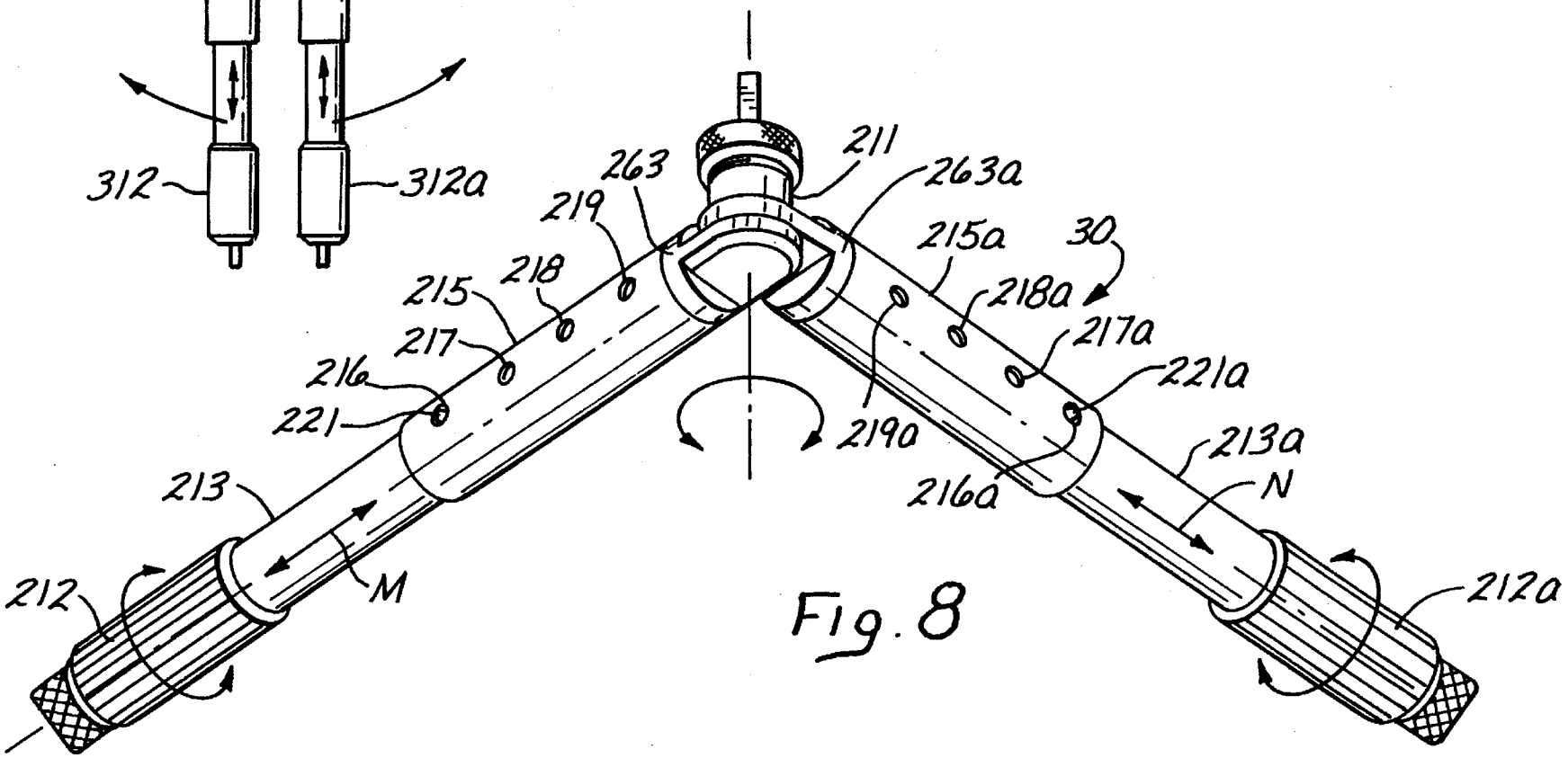
FIG. 8 is an orthographic view of yet another embodiment of the present invention.

Referring now to FIG. 8, there is shown an exercise device 30 which is another embodiment of the present invention. The device 30 includes a pair of handle assemblies 212 and **212*a* and a coupling assembly 211 which are identical in structure and function to the handle assemblies 112 and 112*a* respectively, and the coupling assembly 111 of the exercise device 20. In the device 30, extending from the handle assemblies 212 and 212*a* respectively are hollow rods 213 and 213*a*. A nub 221, capable of being depressed into the rod, projects radially from the rod 213 while a similar nub 221*a* projects from the rod 213*a*. A sleeve 215, interposed between the handle assemble 212 and a ring 263, receives the rod 213 for telescoping movement therewithin. The sleeve 215 has a plurality of openings, such as openings 216 through 219 for receipt of the nub 221. In a similar manner, a sleeve 215*a* is interposed between the handle assembly 212*a* and a ring 263*a*. Openings 216*a* through 219*a* on the sleeve 215*a* are provided, for receipt of the nub 221*a***.

It will be readily noted that the sleeve and rod provisions permit adjustment of the length of the handle assemblies 212 and **212*a* of the exercise device 30** along the lines shown by double headed arrows M and N.

Figure 9:
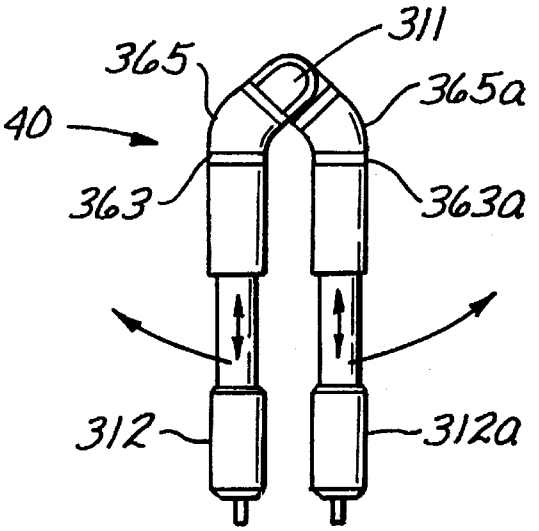
FIG. 9 is an orthographic view of still yet another embodiment of the present invention.

Referring now to FIG. 9, there is shown an exercise device 40 which is another embodiment of the present invention. The device 40 is similar in structure and function to the device 30, having the provision for shortening or lengthening the distance between handle assemblies 312 and **312*a* and a coupling assembly 311. However, in device 40 elbows 365 and 365*a* are interposed between rings 363 and 363*a*, respectively, and the coupling assembly 311**. The elbows enable use of the device in the hedgeclipper mode of exercise while reducing the likelihood of having the user's knuckles strike one another during handle assembly movement.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise device comprising:

a coupling assembly having a first spatulate member having a first elongated arm fixed thereto for rotational movement thereabout, a conical member having a base fixed at an angle to said first spatulate member, an integral anti-rotation boss fixed to said conical member opposite its base, said boss having an integral threaded rod extending therefrom;

a second spatulate member having a second elongated arm fixed at an angle to said second spatulate member for rotational movement thereabout, an elongated receiving member fixed to said second spatulate member perpendicularly to said second elongated arm, said receiving member having a proximal end and a distal end, said distal end having a recess for receipt therein of said conical member for rotational movement thereabout;

an anti-rotation disc fixed to said boss, said disc being received within said receiving member distal end;

an elongated nut disposed coaxially within said receiving member, said nut having a threaded recess at one end for threaded engagement with said threaded rod and having a finger engageable blade at its opposite end;

spring means coaxially disposed between said elongated nut and said anti-rotation disc for frictional engagement therewith; and means for reversibly attaching said elongated nut to said receiving member distal end.

* * * * *